United States Patent [19]

Paulus et al.

[11] 4,191,600

[45] Mar. 4, 1980

[54] METHOD OF CONTINUOUSLY HEAT-TREATING STEEL SHEET OR STRIP

[75] Inventors: Philippe A. Paulus; Marios Economopoulos, both of Liege, Belgium

[73] Assignee: Centre de Recherches Metallurgiques-Centrum voor Research in de Metallurgie, Brussels, Belgium

[21] Appl. No.: 902,258

[22] Filed: May 2, 1978

[30] Foreign Application Priority Data

May 2, 1977 [BE] Belgium ..... 854191

[51] Int. Cl.[2] ..... C21D 9/48; C22C 41/02

[52] U.S. Cl. ..... 148/142; 148/12 C; 148/12.3; 148/36

[58] Field of Search ..... 148/142, 156, 12 C, 148/12.3, 12.4, 12 R, 12.1, 36, 18, 134, 12 F

[56] References Cited

U.S. PATENT DOCUMENTS

| | | | |
|---|---|---|---|
| 3,839,095 | 10/1974 | Kubotera et al. | 148/12 C |
| 3,865,645 | 2/1975 | Takahashi et al. | 148/142 |
| 3,902,927 | 9/1975 | Pernstal | 148/12.1 |
| 3,917,494 | 11/1975 | Kubotera et al. | 148/12 C |
| 3,920,487 | 11/1975 | Gondo et al. | 148/12.3 |
| 3,951,696 | 4/1976 | Gondo et al. | 148/12 R |
| 3,988,173 | 10/1976 | Kawano | 148/12 C |
| 3,988,174 | 10/1976 | Kawano | 148/12 C |
| 4,026,729 | 5/1977 | Nakaoka et al. | 148/12 C |
| 4,040,873 | 8/1977 | Nakaoka | 148/123 |
| 4,065,329 | 12/1977 | Paulus et al. | 148/18 |

*Primary Examiner*—L. Dewayne Rutledge
*Assistant Examiner*—Peter K. Skiff
*Attorney, Agent, or Firm*—Holman & Stern

[57] ABSTRACT

Cold-rolled steel sheet or strip (e.g. containing max. 0.15% C., max. 0.60% Mn, max. 0.020% Si, and 0.001–0.050% B) is heated to a temperature higher than its recrystallization temperature and then cooled by immersion in an aqueous bath at above 75° C.

The cooling by immersion consists of two successive stages, in the first of which cooling occurs at a rate of 25°–180° C./s to 200°–425° C., the product of the cooling rate v in ° C./s times the sheet or strip thickness e in mm being greater than 25, and in the second of which v is 90°–500° C./s and v times e is at least 35. Optionally a further annealing or overageing step comprises holding at 275°–525° C. for 30–250 s.

19 Claims, 1 Drawing Figure

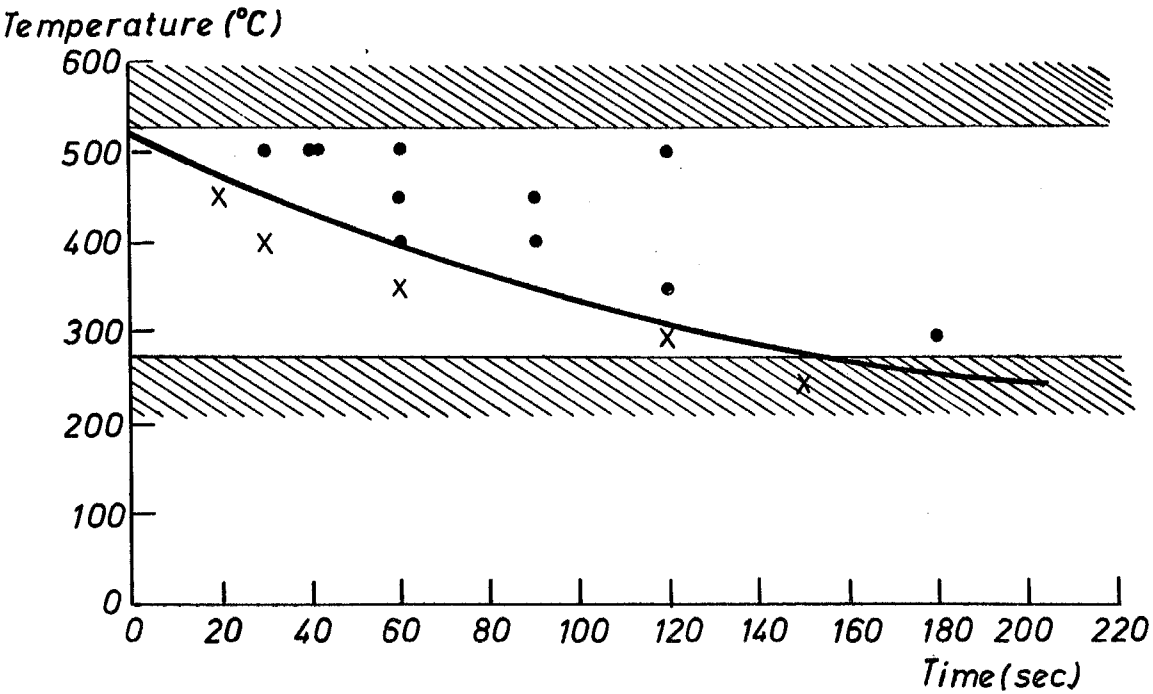
Temperature (°C)
600
500
400
300
200
100
0
0
20
40
60
80
100
120
140
160
180
200
220
Time (sec)

METHOD OF CONTINUOUSLY HEAT-TREATING STEEL SHEET OR STRIP

FIELD OF THE INVENTION

The present invention relates to a method of continuously heat-treating cold-rolled steel sheet or strip. This method is particularly advantageous for giving the sheet or strip an excellent combination of elastic limit and elongation, thereby ensuring great drawability and great uniformity of properties over its entire width. These qualities are especially required in sheet or strip with a high elastic limit used in the motor vehicle industry. In the following text, references to strip are intended to include references to strip, so far as the context allows.

BACKGROUND OF THE INVENTION

When the good ductility, drawing, and elongation properties are to be obtained in cold-rolled strip, the strip is usually subjected to recrystallization annealing in the coiled state in a bell furnace. Such a treatment, however, is very costly for it is of long duration and thus of low productivity. Moreover, the results obtained in this way have a very large scatter.

To remedy these drawbacks, we have already suggested replacing the conventional annealing treatment with a continuous heat-treatment comprising heating the strip to a temperature higher than its recrystallization temperature, and then immersing the heated strip in an aqueous bath maintained substantially at its boiling temperature. The results thus obtained are very satisfactory, especially with strip designed to be drawn, strip having a high elastic limit, and strip with a great tensile strength and large elongation. In some cases, however, it is not easy to obtain and maintain a boiling state throughout the bath. On the contrary, it has been found that, owing to the configuration of the immersion vessel, the movement of the product and the presence of accessories (rollers, cold-water inlet conduits, etc), the aqueous bath has temperature differentials higher than 25° C., which produces satisfactory but heterogeneous results.

It would be desirable to remedy the lack of thermal uniformity of the boiling aqueous bath and to increase the cooling rate. The latter characteristic is particularly advantage-in the case of mild steel because the more rapid the cooling operation the shorter the carbide-nitride precipitation phase, which results in a better ductility and thus in improved drawability.

It is known that the continuous annealing cycle, such as that for white iron, is not suitable for strip designed to be drawn. Such a continuous annealing cycle actually comprises the following four stages: heating to a temperature of about 650° C., soaking at a temperature of about 700° C., controlled cooling to a temperature of the order of 450° C., and rapid cooling to ambient temperature. The two-stage cooling is too rapid for carbon and nitrogen to be able to precipitate in the form of carbo-nitrides. The steel thus obtained is unsuitable for deep drawing because it is too hard and of poor ductility.

For a long time it has been conventional, after a continuous annealing or annealing-galvanization operation, to subject steels to a carbon-precipitation treatment at 300°–400° C. in a bell furnace. Properties are thus obtained which are comparable with those obtained with a conventional method of close annealing.

Continuous methods combining the two operations have already been suggested but are too costly because the furnace needs to be very long to ensure full precipitation of carbon in steel.

The main object of the present invention is a method based on the above described considerations making it possible to obtain satisfactory uniformity of the properties over the entire width of the strip and good ductility while preserving an acceptable duration of treatment.

Another object is a substantial reduction in the duration of the treatment with respect to the conventional methods. We have found that, if rapid cooling after recrystallization is performed at two different and suitable rates, the following carbon precipitation operation is facilitated in the sense that the time necessary for carrying it out is substantially shortened.

Another important reduction in the duration of the carbon precipitation operation (overageing) may result from the division of this operation into two stages. We have also found that it is possible to precipitate carbon at a first temperature in a very short time until the amount of carbon still in the solution approximately corresponds to the equilibrium content at this first temperature. For further decreasing the carbon in solution it is then advantageous to adopt a second, lower temperature at which the equilibrium content of dissolved carbon is lower.

SUMMARY OF THE INVENTION

The method according to the present invention, in which a sheet or strip is heated to a temperature higher than its recrystallization temperature and is then cooled by immersing it in an aqueous bath maintained at a temperature higher than 75° C. (preferably 80° to 150° C.), the said cooling being performed in two successive stages, is substantially characterised in that, in the first stage the cooling rate of the sheet or strip in the aqueous bath is 25° to 180° C. per second (preferably 35° to 150° C. per second) until the temperature of the strip or sheet is 200° to 425° C. and the product of the cooling rate (v) in degrees centigrade per second times the thickness (e) in millimeters is greater than 25, i.e. $(v \times e)_1 > 25$ (preferably greater than 35, i.e. $(v \times e)_1 > 35$), and that in the second stage the cooling rate of the sheet or strip in the aqueous bath is 90° to 500° C. per second (preferably 150° to 450° C. per second) and the product of the cooling rate (v) in centigrade per second times the thickness (e) in millimeters is maintained at a level greater than or equal to 75, i.e. $(v \times e)_2 > 75$ (preferably higher than 95, i.e. $(v \times e)_2 > 95$).

The aqueous bath in which the strip or sheet is immersed preferably is particularly homogeneous especially insofar as the heat distribution is concerned.

According to a first example of carrying out the invention, the value of the product of the cooling rate (v) in degrees centigrade per second times the thickness (e) in millimeters during the first stage is maintained by adjusting the oxidation state of the surface of the strip or sheet at the inlet of the bath and/or the temperature and/or the composition of the bath.

According to a second example, the value of the ratio of $(v \times e)_2$, the cooling rate the thickness during the second stage, to $(v \times e)_1$ the product of the same quantities during the first stage, i.e. $(v \times e)_2/(v \times e)_1$ is between 1.5 and 5, preferably between 2 and 4.

The heating operation is advantageously carried out in a direct-fired furnace of the non-oxidizing or little oxidizing type.

According to another example of the invention, the sheet or strip cooled by being immersed in a hot aqueous bath is subjected to annealing or overageing.

In a particularly satisfactory application of the invention, the strip or sheet consists of high tensile steel.

According to a still further example of the invention, the strip or sheet after having been heated above its recrystallization temperature is maintained at a temperature of 700° to 1000° C., preferably 750° C. to 960° C.

Preferably, the strip or sheet is immersed in a hot aqueous bath for more than 5 seconds, so that the strip or sheet attains a temperature of 80° to 150° C.

Moreover, the sheet or strip is preferably heated at the outlet of the aqueous bath to a temperature of 200° to 525° C. for a time longer than 15 seconds.

In another particularly advantageous application of the invention, the sheet or strip consists of mild steel suitable for being drawn.

The strip or sheet after having been heated above its recrystallization temperature is advantageously kept at a temperature lower than 840° C., preferably lower than 780° C.

The strip or sheet cooled by immersion in an aqueous bath is advantageously subjected to an annealing or overageing operation comprising heating the said strip or sheet to a temperature of 275° to 525° C., preferably 380° to 490° C., for a time between 30 and 250 seconds, preferably between 40 and 180 seconds, which makes it possible to increase the ductility of the metal.

According to a particularly advantageous example of the invention the dwelling time t (s) for which the strip or sheet is kept at the annealing or overageing temperature T (°C) is at least equal to that given by the following formula:

$$t=(94500/T)-180$$

Furthermore, the annealing or overageing operation preferably includes slow cooling down to a temperature lower than 400° C., preferably lower than 350° C., before starting the final cooling stage.

It may be advantageous to carry out the cooling or overageing operation in two stages: one at a temperature of 400° to 500° C. and the other at a temperature of 300° to 400° C., rapid cooling being effected between these two stages.

In the case in which the annealing or overageing operation is carried out in two stages with intermediate rapid cooling, the rapid cooling may be a quenching operation in an aqueous bath at a temperature higher than or equal to 60° C., preferably higher than or equal to 80° C.

In the case in which the annealing or overageing operation is carried out in two stages, it is preferable for the first stage to take a time equal to or longer than 10 seconds, preferably equal to or longer than 20 seconds and the second stage to take a time equal to or greater than 15 seconds, preferably equal or longer than 20 seconds.

According to the invention, the composition of the treated steel may be:

$C \leqq 0.15\%$ (preferably $\leqq 0.10\%$)
$Mn \leqq 0.60\%$ (preferably $\leqq 0.50\%$)
$Si \leqq 0.020\%$.

Moreover, according to the invention, boron may be added in an amount of 0.001 to 0.050%.

Furthermore, according to the invention the boron and nitrogen contents in the steel satisfy the equation:

$$B=K.N$$

where B = wt.% boron; N = wt.% nitrogen, and K is a coefficient between 1 and 3.

The inventors have found that, by subjecting such a steel to the cycle in accordance with the invention, a product is obtained in which any ageing tendency has been eliminated.

According to an advantageous example of the invention, after the annealing or overageing operation the strip is slowly cooled to the ambient temperature by using conventional means such as by blowing atmospheric gas, water-jacket, etc.

According to a variant of the invention, after the annealing or overageing operation, strip is quenched in an aqueous bath at a temperature higher than or equal to 60° C., preferably higher than or equal to 80° C.

According to another example of the invention, the aqueous bath is followed by, or serves as, a means for surface treatment such as pickling, rinsing, passivation, or metallic or nonmetallic coating (phosphating).

According to a further example of the invention, the various aqueous baths communicate with one another, for example by passing from one vessel to another in a direction opposite to the direction of movement of the strip or sheet. The vapours from the various aqueous baths are advantageously condensed in a common condenser and condensation water is advantageously used for final rinsing.

The following description illustrates an indicative, non-limiting example.

Mild-steel strip suitable for drawing

A 17 ton ingot of rimming steel was produced in the factory in a conventional manner. The ingot was transformed into a flat bloom and then hot rolled with the following characteristics:

temperature at the end of the hot rolling operation: 885° C.
coiling temperature: 620° C.
final thickness: 2.5 mm.

The composition of the strip thus obtained is given below (in wt.%).

| C | Mn | Si | P | S | Al |
|---|---|---|---|---|---|
| 0.028 | 0.240 | 0.004 | 0.009 | 0.011 | — |

The strip coil was then descaled by means of hydrochloric acid, then cold rolled at a reduction rate of 60% to obtain a final thickness of 1 mm.

Samples of cold-rolled strip were taken and subjected to the following treatments.

Conventional treatment

Annealing according to the conventional method in a coiled state in a bell furnace for 12 hours at 700° C. Skinpass with a reduction rate of 1%.

Cycle A heating in 40 s to 800° C.;
holding at 800° C. for 40 s;
cooling at a constant speed of 20° C./S, TABLE OF PROPERTIES-continued

| Cycle | Erichsen test mm | Elastic limit kg/mm² | Tensile Strength kg/mm² | Elonga-Tion,% (50mm gage length | Aniso-tropy coeffi-cient | Yield elongation (after gageing 100° C., 1h) |
|---|---|---|---|---|---|---|
| Cycles G | | | | | | |
| G1 | 10.9 | 22.7 | 32.8 | 10.5 | 1.36 | 2.8 |
| * G2 | 11.1 | 21.8 | 32.4 | 44.2 | 1.30 | 2.0 |
| * G3 | 11.4 | 21.0 | 31.5 | 46.4 | 1.38 | 1.2 |
| Cycles H | | | | | | |
| * H1 | 11.2 | 21.8 | 32.3 | 45.2 | 1.35 | 2.0 |
| * H2 | 11.2 | 21.7 | 32.6 | 44.0 | 1.32 | 2.2 |
| * H3 | 11.1 | 22.0 | 32.8 | 44.0 | 1.35 | 2.2 |
| * H4 | 11.0 | 22.4 | 32.8 | 43.1 | 1.34 | 2.4 |
| Cycles I | | | | | | |
| * I1 | 11.1 | 21.8 | 32.3 | 43.1 | 1.38 | 2.0 |
| * I2 | 11.0 | 21.9 | 32.7 | 42.4 | 1.59 | 2.2 |
| * I3 | 11.1 | 21.7 | 32.5 | 44.2 | 1.32 | 2.0 |
| * I4 | 11.4 | 20.9 | 31.9 | 47.0 | 1.34 | 1.5 |

* in accordance with the invention

It is found that the properties vary little with the recrystallization temperature although it seems to be advantageous from the point of view of elongation to recrystallize at a relatively low temperature (650° to 780° C.).

Comparison between cycles A and B on the one hand and the cycles (D2, E2, F2, F3, G2, G3, H1, H2, H3, I1, I2, I3, I4) in accordance with the invention clearly suggests that it is advantageous to rapidly cool in two stages, a first stage at a rate such that $(v \times e)_1$ is higher than 25 and a second stage at a rate such that $(v \times e)_2$ is higher than 75.

Moreover, the overageing treatment is very important and comparison of cycles C to H shows that:

(1) the overageing temperature should be higher than or equal to 275° C.;

(2) good properties, i.e. especially ultimate elongation higher than or equal to 41%, are obtained for cycles D2, E2, F2, F3, G2, G3, H1, H2, H3, H4 when the holding time, in seconds, at the overageing temperature is equal to or higher than (94,500/T)−180 where T is the overageing temperature in °C. (see the accompanying drawing). On the other hand, and especially for high overageing temperatures, it is not expedient to prolong this holding time excessively for in that case a large amount of carbon remains in solution, as is clearly seen when comparing cycle H4 with cycle H1.

Finally, comparison of cycles I with cycles G shows that it is possible to shorten the final cooling provided the final cooling is not started at too high a temperature. The ideal procedure would be to carry out the overageing operation in two stages so as to keep in solution only the amount of carbon corresponding to the equilibrium at the lowest of the chosen temperatures.

DESCRIPTION OF THE DRAWING

In the graph in the accompanying drawing the holding time at the overageing temperature is shown as the abscissa and the overageing temperature as the ordinate (T, °C.).

Results considered to be unsatisfactory are indicated by crosses and results considered to be satisfactory are indicated by points.

The solid line indicates the durations (in seconds) of the holding times (t) at the overageing temperature satisfying the following equation:

$$t=(94{,}500/t)-180$$

Generally speaking, it should be noted that all the results located above the curve are satisfactory and the areas between the shaded portions correspond to the domain of the invention, i.e. they correspond to temperatures from 275° C. to 525° C.

It should be noted that all the points in the figure relate to final cooling in the air (cycles C to H).

We claim:

1. In a method of continuously heat treating cold-rolled steel strip or sheets, in which the strip or sheet is heated to a temperature higher than its recrystallisation temperature and subsequently cooled in two steps, the first taking place by immersion in an aqueous bath, the temperature of which is between 80° C. and 150° C., cooling taking place at a speed between 25° C./sec and 180° C./sec., the product of this speed times the thickness of the strip or sheet being higher than 25, the improvement wherein the first step ends when the temperature of the strip or sheet is between 200° C. and 425° C., and the second step also takes place in an aqueous bath, at a cooling speed between 90° C./sec and 500° C./sec to a temperature between 80° C. and 150° C., the product of the thickness of the strip or sheet times the cooling speed of the second step being higher than 75.

2. The method of claim 1, in which the ratio of the product of rate times thickness in the second stage and the product of rate times thickness in the first stage is in the range from 1.5 to 5.

3. The method of claim 2, in which the said ratio is in the range from 2 to 4.

4. The method of claim 1, further comprising the step of:

(c) annealing or overageing the sheet or strip by heating the sheet or strip to a temperature of 275° to 525° C. and holding it at that temperature for a time of 30 to 250 seconds.

5. The method of claim 4, in which the said temperature is 380° to 490° C.

6. The method of claim 4, in which the said time is 40 to 180 seconds.

7. The method of claim 4, in which the said time, t, in seconds, is related to the said temperature, T, in degrees centigrade, by the following equation: $t=(94{,}500/T)-180$.

i.e. $v \times e = 20$ (immersion in an aqueous bath at 90° C.);
reheating to 450° C. in 15 s;
holding at 450° C. for 45 s;
cooling in the air for 45 s down to 70° C.;
skin-pass: 1%.

Cycle B heating in 30 s to 750° C.;
holding between 700° and 750° C. for 40 s;
cooling at a constant speed of 50° C./s
and then at a speed of 60° C./S down to 90° C.,
i.e. $(v \times e)_1 = 45$ and $(v \times e)_2 = 60$ (immersion in an aqueous bath at 90° C.);
reheating to 450° C. in 15 s;
holding at 450° C. for 45 s;
cooling in the air for 45 s down to 70° C.;
skin-pass: 1%.

The following cycles C to I all have a common first stage of treatment consisting of heating, recrystallization, and rapid cooling, and they differ from one another only in the subsequent overageing operation.

Cycles C to I, common first stage:
heating to 700° C. in 25 s,
holding between 720° and 680° C. for 50 s,
rapid cooling in a bath at 85° C. in two steps:
(1) at a speed of 55° C./s down to 240° C., $(v \times e)_1 = 55$,
(2) at a speed of 150° C./s from 240° C. down to 85° C., $(v \times e)_2 = 150$,
$(v \times e)_2/(v \times e)_1 = 2.73$ Cycle C first stage described above and then:
reheating in 10 s to 250° C.
(lower than according to the invention: 275° C.);
holding at this temperature for 150 s;
final cooling in the air for 25 s down to 70° C.;
skin-pass: 1%

Cycles D (2)

first stage as described above and then:
reheating in 10 s to 300° C.;
D1—holding at this temperature for 120 s or
D2—holding at this temperature for 180 s;
final cooling in the air for 30 s down to 70° C.;
skin-pass: 1%.

Cycles E (2)

first stage as described above and then:
reheating in 12 s to 350° C.;
E1—holding at this temperature for 60 s or
E2—holding at this temperature for 120 s;
final cooling in the air for 35 s down to 70° C.;
skin-pass: 1%.

Cycles F (3)

first stage as described above and then:
reheating in 14 s to 400° C.;
F1—dwelling at this temperature for 30 s or
F2—dwelling at this temperature for 60 s or
F3—dwelling at this temperature for 90 s;
final cooling in the air for 40 s down to 70° C.;
skin-pass: 1%.

Cycles G (3)

first stage as described above and then:
reheating in 15 s to 450° C.;
G1—holding at this temperature for 20 s or
G2—holding at this temperature for 60 s or
G3—holding at this temperature for 90 s;
final cooling in the air for 45 s down to 70° C.;
skin-pass: 1%.

Cycles H (4)

first stage as described above and then:
reheating in 18 s to 500° C.;
H1—holding at this temperature for 30 s or
H2—holding at this temperature for 40 s or
H3—holding at this temperature for 60 s or
H4—holding at this temperature for 120 s;
cooling in the air for 50 s down to 70° C.;
skin-pass: 1%.

Cycles I first stage as described above and then:
reheating in 15 s to 450° C.;
holding at 450° C. for 40 s;
I1—cooling in the air, or
I2—cooling in a bath at 85° C., or
I3—cooling in 20 s down to 300° C. then cooling in a bath at 85° C., or
I4—cooling down to 350° C. in a bath at 100° C. containing surfactants,
holding at 350° C. for 30 s,
cooling in a bath at 70° C.

TABLE OF PROPERTIES

| Cycle | Erichsen test mm | Elastic limit kg/mm² | Tensile Strength kg/mm² | Elonga-Tion,% (50mm gage length | Aniso-tropy coeffi-cient | Yield elongation (after gageing 100° C., 1h) |
|---|---|---|---|---|---|---|
| Conven-tional annealing | 11.3 | 20.0 | 30.0 | 45.0 | 1.15 | 9.0 |
| Cycle A | 11.2 | 24.4 | 34.1 | 39.5 | 1.33 | 4.4 |
| Cycle B | 11.3 | 22.9 | 33.5 | 40.0 | 1.57 | 2.8 |
| Cycle C | 10.7 | 30.1 | 37.5 | 56.1 | 1.55 | 4.5 |
| Cycles D | | | | | | |
| D1 | 10.8 | 23.4 | 34.0 | 39.0 | 1.34 | 3.4 |
| * D2 | 11.0 | 22.4 | 32.7 | 41.0 | 1.35 | 2.0 |
| Cycles E | | | | | | |
| E1 | 10.8 | 23.1 | 33.5 | 40.0 | 1.37 | 4.2 |
| * E2 | 11.0 | 22.3 | 32.6 | 41.4 | 1.36 | 1.8 |
| Cycles F | | | | | | |
| F1 | 10.8 | 23.0 | 33.4 | 40.0 | 1.31 | 3.7 |
| * F2 | 11.0 | 22.0 | 32.6 | 41.6 | 1.34 | 1.9 |
| * F3 | 11.2 | 21.4 | 32.1 | 43.4 | 1.32 | 1.4 |

8. The method of claim 4, including, after holding the sheet or strip at the said temperature for the said time, slowly cooling it to a temperature below 400° C.

9. The method of claim 8, in which the slow cooling is to a temperature below 350° C.

10. The method of claim 4, in which step (c) comprises heating the sheet or strip to a first temperature of 400° to 500° C., holding it at the first temperature, rapidly cooling it to a second temperature of 300° to 400° C., and holding it at the second temperature.

11. The method of claim 10, in which the rapid cooling step comprises quenching the sheet or strip in an aqueous bath at a temperature of at least 60° C.

12. The method of claim 11, in which the bath temperature is at least 80° C.

13. The method of claim 10, in which the holding time at the first temperature is at least 10 seconds and the holding time at the second temperature is at least 15 seconds.

14. The method of claim 13, in which the said holding times are each at least 20 seconds.

15. The method of claim 1, in which the steel contains max. 0.15% C, max. 0.60% Mn, and max. 0.020% Si.

16. The method of claim 15, in which the carbon content is max. 0.10%.

17. The method of claim 15, in which the manganese content is max. 0.50%.

18. The method of claim 15, in which the steel additionally contains 0.001 to 0.050% B.

19. The method of claim 18, in which the steel additionally contains nitrogen in an amount such that the boron and nitrogen contents satisfy the following equation:

$$B = K.N$$

where B is percentage of boron
N is percentage of nitrogen
K is a coefficient ranging from 1 to 3.

* * * * *